US009574477B1

(12) United States Patent
Burger

(10) Patent No.: US 9,574,477 B1
(45) Date of Patent: Feb. 21, 2017

(54) METHOD FOR OPERATING A REAGENT METERING SYSTEM, DEVICE FOR CARRYING OUT THE METHOD, COMPUTER PROGRAM AND COMPUTER PROGRAM PRODUCT

(71) Applicant: Robert Bosch GmbH, Stuttgart (DE)

(72) Inventor: Matthias Burger, Murr (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/251,109

(22) Filed: Aug. 30, 2016

(30) Foreign Application Priority Data

Sep. 2, 2015 (DE) ..... 10 2015 216 745

(51) Int. Cl.

| | |
|---|---|
| ***F01N 3/00*** | (2006.01) |
| ***F01N 3/20*** | (2006.01) |
| ***F01N 9/00*** | (2006.01) |
| ***F04B 19/22*** | (2006.01) |
| ***F04B 17/04*** | (2006.01) |
| ***F04B 49/06*** | (2006.01) |

(52) U.S. Cl.
CPC ..... *F01N 3/206* (2013.01); *F01N 9/00* (2013.01); *F04B 17/04* (2013.01); *F04B 19/22* (2013.01); *F04B 49/06* (2013.01); *F01N 2390/02* (2013.01); *F01N 2610/144* (2013.01); *F04B 2201/0209* (2013.01); *F04B 2203/0401* (2013.01)

(58) Field of Classification Search
CPC ..... F01N 2610/144; F01N 3/206; F01N 9/00; F01N 2390/02; F04B 2201/0209; F04B 2203/0401; F04B 19/22; F04B 17/04; F04B 49/06
See application file for complete search history.

(56) References Cited

U.S. PATENT DOCUMENTS

| | | | | |
|---|---|---|---|---|
| 5,635,070 | A * | 6/1997 | Allington ..... | B01D 11/0203 210/416.1 |
| 5,892,649 | A | 4/1999 | Kahr et al. | |
| 5,917,692 | A | 6/1999 | Schmitz et al. | |
| 6,394,414 | B1 | 5/2002 | Breitling et al. | |

(Continued)

FOREIGN PATENT DOCUMENTS

| | | |
|---|---|---|
| DE | 19530121 | 2/1997 |
| DE | 19607073 | 8/1997 |

(Continued)

*Primary Examiner* — Jesse Bogue
(74) *Attorney, Agent, or Firm* — Michael Best & Friedrich LLP

(57) ABSTRACT

A method for operating a reagent metering system which meters a reagent into an exhaust duct of an internal combustion engine upstream of an SCR catalytic converter, in which, after the metering operation is ended, at least part of the reagent metering system is emptied by back-suction by means of a reciprocating pump. The procedure according to the invention is distinguished in that during the back-suction, a stop determination determines the flight time of a reciprocating piston of the reciprocating pump from a starting time as far as the stop time, in that a comparator compares the flight time determined with a flight time threshold value, and in that the activation power of the reciprocating pump is reduced if the flight time determined is less than the flight time threshold value.

7 Claims, 2 Drawing Sheets

(56) References Cited

U.S. PATENT DOCUMENTS

| | | | | |
|---|---|---|---|---|
| 6,568,416 | B2 * | 5/2003 | Tucker | G05D 16/2053 137/14 |
| 2003/0173834 | A1 * | 9/2003 | McGill | F04B 35/045 310/12.19 |
| 2008/0314238 | A1 | 12/2008 | Neuner | |
| 2009/0019835 | A1 * | 1/2009 | Dingle | F01N 11/00 60/282 |
| 2016/0010529 | A1 * | 1/2016 | Wang | F17D 3/00 60/274 |

FOREIGN PATENT DOCUMENTS

| | | |
|---|---|---|
| DE | 19719602 | 11/1998 |
| DE | 102007028059 | 3/2009 |
| DE | 102009027417 | 1/2011 |
| DE | 102011076429 | 11/2012 |
| DE | 102011088701 | 6/2013 |

* cited by examiner

METHOD FOR OPERATING A REAGENT METERING SYSTEM, DEVICE FOR CARRYING OUT THE METHOD, COMPUTER PROGRAM AND COMPUTER PROGRAM PRODUCT

BACKGROUND OF THE INVENTION

The invention relates to a method for operating a reagent metering system which meters a reagent into the exhaust duct of an internal combustion engine upstream of an SCR catalytic converter, and to a device for carrying out the method.

The invention furthermore relates to a control device, with the aid of which the reagent metering system is operated, and to a control device program product with a program code stored on a machine-readable storage medium, for carrying out the method.

To aftertreat the exhaust gas of an internal combustion engine, use can be made of selective catalytic reduction (SCR), with the aim of reducing NOx in the exhaust gas. In this connection, a defined quantity of a selectively acting reagent is metered into the exhaust duct of the internal combustion engine. The reagent can be ammonia which is acquired, for example, from a precursor in the form of a urea-water solution in the exhaust duct by hydrolysis.

Such a reagent metering system is known, for example, from laid-open application DE 196 07 073 A1. The urea-water solution is conveyed here through a line from a tank to a metering valve and is metered into an exhaust duct of an internal combustion engine upstream of an SCR catalytic converter, wherein the metering rate is defined by means of the metering valve.

In current reagent metering systems, as are known under the applicant's designation DENOXTRONIC, a pump sucks the urea-water solution out of a reagent tank and compresses said solution to the system pressure required for atomizing, of, for example, 3 to 9 bar. The metering rate of the reagent is coordinated to the maximum possible NOx reduction by taking into consideration, for example, current internal combustion engine data and catalytic converter data.

The urea-water solution which is customarily used and is defined in DIN standards has the property of freezing at approximately −11° C. The volumetric expansion of the urea-water solution that is associated with the freezing may lead to damage to the lines and to further components, such as, for example, pump or metering valve. Therefore, it can be provided, after shutting down the internal combustion engine or after switching off the reagent metering system, to suck the urea-water solution back from the reagent metering system, in particular from the metering valve, into the tank. The effect is therefore achieved that the reagent metering system can freeze at temperatures of −11° C. or therebelow without there being any concern about damage due to the volumetric expansion of the freezing urea-water solution.

Laid-open application DE 10 2011 076 429 describes such a reagent metering system in which a pump can be switched over from a forwards operation to a reverse operation such that the pump, in addition to the building up of the predetermined system pressure, additionally permits the reagent to be sucked back.

Purely in principle, it is possible, instead of a pump driven by a rotating electric motor, to provide a solenoid actuator, specifically a reciprocating pump, in which an armature surrounded by a solenoid carries out a reciprocating movement. Such reciprocating pumps are activated, for example, by a periodically repeating squarewave signal. An activation duration is set here within a period in such a manner that a complete stroke of the plunger-type armature takes place.

A disadvantage of such solenoid actuators or reciprocating pumps is the high generation of noise at the armature stop. Patent DE 10 2007 028 059 B4 therefore describes a reciprocating pump for delivering a liquid, in which an impact damper made of elastomer is provided for reducing the noise. In addition, kinetic energy of the reciprocating piston is absorbed by a resetting spring and hydraulic damping. The mechanical design of the reciprocating pump is correspondingly complicated. The result is high manufacturing costs. Furthermore, the mechanically heavily loaded impact damper is exposed to increased wear which reduces the lifespan of the reciprocating pump.

Laid-open application DE 10 2011 088 701 A1 discloses a method for monitoring the armature movement of a reciprocating solenoid pump, in particular in the delivery module of a reagent metering system. For this purpose, a local minimum value in the current characteristic through the solenoid of the reciprocating solenoid pump is sought and identified as the time of the armature striking against an armature stop. In order to ascertain the local minimum value, use can be made of the passage through zero of the first time derivative of the current characteristic.

Laid-open application DE 197 19 602 A1 describes an activation of an electromagnetic valve having an armature. The armature is moved from a closed position of the valve into an open position and is kept in the latter. The activation is configured in such a way that it outputs a comparatively high voltage until the armature is released, outputs a smaller voltage during the flight phase of the armature and, after the open position is reached, again outputs a high retaining voltage to the solenoid of the valve. According to one embodiment, switching times for switching over between the voltages can be ascertained depending on the time characteristic of the current through the solenoid. The current curve here shows the known characteristic dependencies on the movement of the armature. The reduced voltage during the flight phase leads to a reduced acceleration of the armature. A speed is thereby set which is of a size sufficient in order to ensure secure closing of the valve, but is low enough for a generation of noise when the armature impacts against the end stop to be reduced.

It is the object of the invention to provide a method and a device with which a reduction in the generation of noise of a reciprocating pump is obtained.

SUMMARY OF THE INVENTION

The procedure according to the invention is based on a method for operating a reagent metering system which meters a reagent into an exhaust duct of an internal combustion engine upstream of an SCR catalytic converter, in which, after the metering operation is ended, at least part of the reagent metering system is emptied by back-suction by means of a reciprocating pump. The procedure according to the invention is distinguished in that during the back-suction, a stop determination determines the flight time of the reciprocating piston of the reciprocating pump from the starting time as far as the stop time, in that a comparator compares the flight time determined with a flight time threshold value, and in that the activation power of the reciprocating pump is reduced if the flight time determined is less than the flight time threshold value.

In current reagent metering systems of the type in question, a reciprocating pump is used for sucking the reagent back from the reagent metering system to a tank in order to prevent possible freezing of the reagent. If a urea-water solution is provided as the reagent, freezing has to be expected from a temperature below −11° C.

A reciprocating pump which is provided only for the back-suction can be provided. Alternatively, a reciprocating pump can be provided which both provides the operating pressure of the reagent and brings about the back-suction, wherein, in this case, valves are required for switching over between the normal metering operation and the back-suction.

When the armature or the reciprocating piston strikes against an end stop, a reciprocating pump produces a noise which greatly increases if reagent is absent because, in this case, the hydraulic counterforce on the reciprocating piston during the piston stroke is absent. As a result, the reciprocating piston strikes with correspondingly higher energy against the end stop. The increased generation of noise appears particularly annoying because of the fact that the increased noise may occur with the internal combustion engine already switched off.

By means of the procedure according to the invention, a magnetic force excess during the delivery stroke of the reciprocating pump is identified and, as a result, the current of the solenoid of the reciprocating pump, and therefore the magnetic attraction force, is reduced. The current is reduced to a value which continues to lead to the actuation of the reciprocating pump but wherein the generation of noise during the striking of the reciprocating piston against the end stop is significantly lower than when the full activation power of the reciprocating pump is provided.

According to a refinement, it is provided that the stop determination determines the reaching of the striking of the reciprocating piston of the reciprocating pump against the end stop on the basis of an assessment of the temporal current characteristic of the current flowing through the solenoid of the reciprocating pump. Use is made of the fact that, when the end stop is reached, the inductance of the magnetic circuit has a relatively large jump in a short time. The current dip caused by the rapid increase in the inductance can be identified by determining and assessing the first time derivative and/or the second derivative of the current.

A refinement provides that the average activation power of the reciprocating pump is defined by means of a pulse-width-modulated signal. The reduction in the average activation power can then be achieved simply on the basis of a change in a characteristic variable of the pulse-width-modulated signal, for example by reducing the pulse duration.

According to another refinement, it is provided that, after the average activation power of the reciprocating pump is reduced, the flight time of the piston until the stop is reached is furthermore determined, that a comparison of the flight time with the flight time threshold value is furthermore undertaken, and that, whenever the flight time exceeds the flight time threshold value, the reduction in the average activation power is ended. This situation occurs if the reciprocating pump is filled again with the reagent to be sucked back since, because of the reduced activation power of the reciprocating pump, the flight time when reagent is present is significantly increased, and therefore the flight time threshold value is exceeded. With this refinement, a simple and in particular rapid return to the normal back-suction operation of the reciprocating pump is possible without adaptation processes or test strokes.

The device according to the invention for carrying out the method provides a specially designed control device which is capable of carrying out the individual method steps and of triggering the required actions.

The control device program according to the invention provides that all of the steps of the method according to the invention are executed when it runs on a control device.

The control device program product according to the invention with a program code stored on a machine-readable storage medium executes the method according to the invention when the program is executed on a control device.

Further advantageous developments and refinements of the procedure according to the invention emerge from the description.

BRIEF DESCRIPTION OF THE DRAWINGS

An exemplary embodiment of the invention is illustrated in the drawing and explained in more detail in the description below.

DETAILED DESCRIPTION

Figure 1:
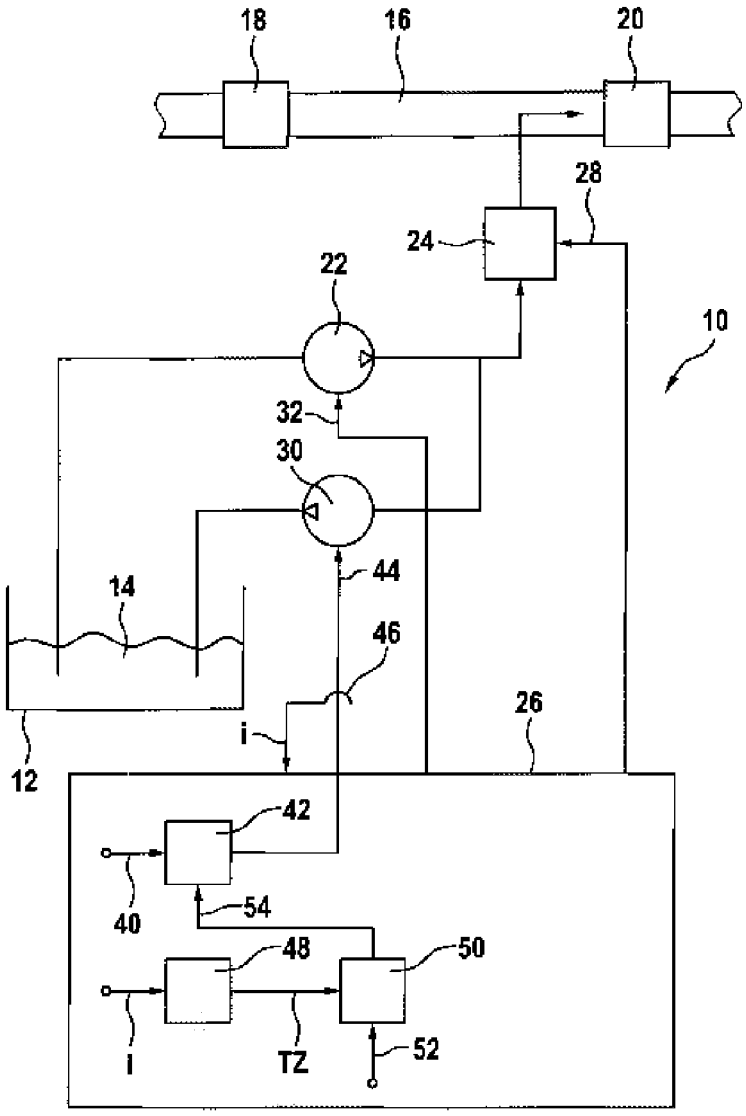
FIG. 1 shows a technical environment in which a method according to the invention runs.

FIG. 1 shows a reagent metering system 10 which meters a reagent 14 stored in a tank 12 into an exhaust duct 16 of an internal combustion engine 18 upstream of an SCR catalytic converter 20. The reagent 14 is preferably a urea-water solution which is a precursor of the reagent ammonia required in the SCR catalytic converter 20. Only the term reagent 14 is used below.

The reagent 14 is brought by a pump 22 to an operating pressure which lies, for example, within a range of 3-9 bar. The metering rate of the reagent 14 is defined by a metering valve 24 which is activated with a metering signal 28 by a control device 26.

Depending on the configuration of the reagent 14, the reagent 14 may freeze below a certain temperature. If a urea-water solution is provided as the reagent 14, freezing below −11° C. has to be anticipated. In order to avoid damage in the reagent metering system 10, back-suction of the reagent 14 is therefore provided, at least whenever a dropping of the ambient temperature below the freezing temperature of the reagent 14 should be anticipated.

The reagent metering system 10 is intended to be emptied in the overrunning of the control device 26, in which the control device 26 is still supplied with current for carrying out further tasks after the internal combustion engine 18 is shut down and after the metering operation is ended. For the back-suction of the reagent, a reciprocating pump 30 is provided. In the exemplary embodiment shown, the reciprocating pump 30 is provided as a separate pump which is present in addition to the pump 22. Alternatively, a single reciprocating pump can be provided, wherein, in this case, valves have to be provided so that a switch can be made between metering operation and back-suction operation. In the exemplary embodiment shown in FIG. 1, the pump 22 is activated by a pump signal 32 which the control device 26 provides.

If the internal combustion engine 18 is intended to be switched off, a switching-off signal 40 which is made available to an activation means 42 occurs within the context of overrunning of the control device 26, within which the control device 26 is still supplied with energy. The activation means 42 provides an activation signal 44 which is made available to the reciprocating pump 30. The activation signal 44 is preferably a pulse-width-modulated signal, and therefore simple power control of the reciprocating pump 30 is possible.

Figure 2:
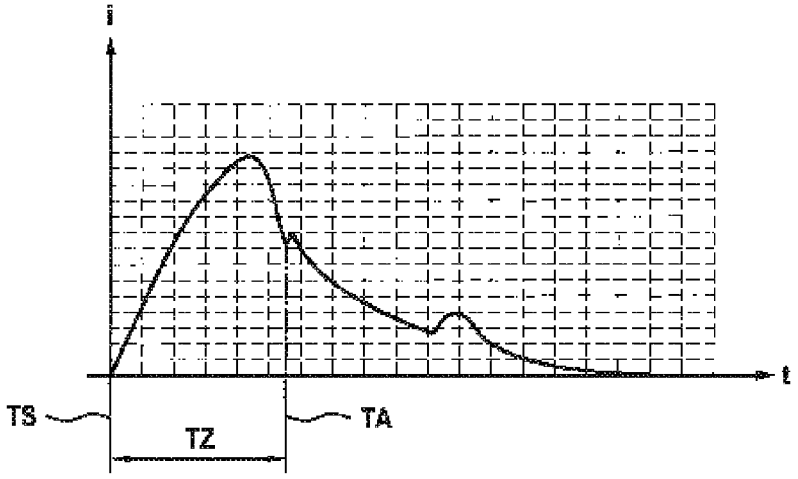
FIGS. 2 and 3 show signal variations as a function of the time.
Figure 3:
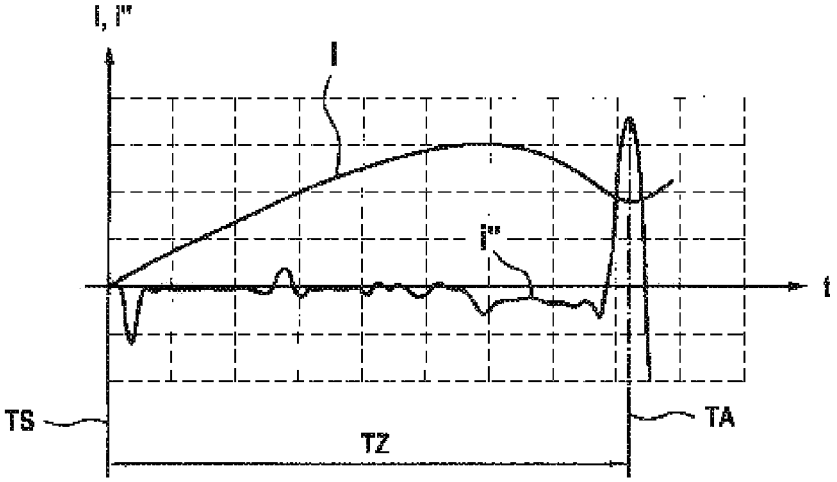

After the occurrence of the switching-off signal 40, the activation signal 44 is provided at a starting time TS, shown in FIGS. 2 and 3, and the back-suction operation begins. The reciprocating piston (not shown specifically) of the reciprocating pump 30, which reciprocating piston is connected to an armature (not shown specifically) of the reciprocating pump 30, executes a stroke movement because of the energizing of the solenoid of the reciprocating pump with the current i. On account of the inductance of the solenoid, which depends on the solenoid itself, but also on the entire magnetic circuit consisting of armature and piston of the reciprocating pump 30, the current i cannot increase abruptly, but rather at least approximately has a characteristic as shown in FIGS. 2 and 3.

If the reciprocating pump 30 is filled with the reagent 14 during the back-suction, a normal operating noise occurs which is caused in particular by the reciprocating piston of the reciprocating pump 30 striking against an end stop. However, this noise greatly increases if air bubbles or no reagent 14 at all are or is present in the reciprocating pump 30. In this case, the counterforce due to the reagent 14 is missing, and therefore, when the power supply to the reciprocating pump 30 is unchanged, the stroke movement becomes more rapid and the striking noise becomes correspondingly louder. In particular, the increase in the noise is unpleasant for a user of the reagent metering system 10 since, at the time of the back-suction of the reagent 14, the internal combustion engine 18 is already switched off, and therefore the general noise level is reduced and the annoying noise caused by the reciprocating pump 30 is more noticeable.

According to the invention, it is therefore provided to reduce the average power made available to the reciprocating pump 30 if the load is reduced because of the formation of bubbles in the reciprocating pump 30. The flight time TZ of the reciprocating piston of the reciprocating pump 30 is used as a measure for the reduction in the mechanical load of the reciprocating pump 30. The determination of the flight time TZ of the reciprocating piston of the reciprocating pump 30 is provided, beginning at a starting time TS until the end stop is reached at the stop time TA. The flight time TZ is subsequently compared with a flight time threshold value.

If the flight time TZ is less than the flight time threshold value, the activation power of the reciprocating pump 30 is reduced. The reduced power ensures that the reciprocating piston moves more slowly, and therefore the striking of the reciprocating piston of the reciprocating pump 30 against the end stop also takes place with less noise.

According to a refinement, the flight time TZ of the armature or of the reciprocating piston of the reciprocating pump 30 is determined on the basis of an assessment of the current i during the back-suction, which current is detected by a current sensor 46. For this purpose, a stop determination 48 assesses the current i by forming, for example, the first and/or second time derivative i', i" of the current i. As soon as the armature or the reciprocating piston of the reciprocating pump 30 reaches the end stop, a great change in the inductance of the inductive circuit described further above occurs in a short time. The great increase in the inductance leads to a characteristic dip in the current i at the stop time TA. The change in the current i can lead to the passage through zero of the first derivative i' of the current i. The change in the current i can also take place in such a manner that a turning point in the current characteristic occurs, which turning point can be identified on the basis of an assessment of the second derivative i" of the temporal current characteristic.

As soon as the stop determination 48 has identified the reaching of the end stop at the stop time TA the flight time TZ is determined from the time difference between the starting time TS and the stop time TA and made available to a comparator 50. The comparator 50 compares the flight time TZ with the flight time threshold value 52. If the flight time TZ determined is less than the flight time threshold value 52, the comparator 50 provides a switching signal 54 which triggers the activation means 42 to change the activation signal 44 of the reciprocating pump 30 in such a manner that a lower average power is made available to the reciprocating pump 30.

If the refinement, already described, of the activation signal 44 is provided as a pulse-width-modulated activation signal, the average power can be reduced in a simple manner by changing a characteristic variable of the pulse-width-modulated signal, for example a reduction in the pulse duration.

The reduction in the average power made available to the reciprocating pump 30 causes the movement of the armature or the reciprocating piston of the reciprocating pump 30 to slow down. The reduction in the power has to be pursued in such a manner that the reciprocating piston of the reciprocating pump 30 continues to reach the end stop, wherein, however, the generation of noise is reduced. The reduced power is preferably determined experimentally.

As soon as the reciprocating pump 30 is filled again with the reagent 14, a return can be made to the normal back-suction operation with full power. The return to the normal back-suction operation with the normal power of the reciprocating pump 30 can be initiated by the simple measure that the stop identification 48 furthermore determines the flight time TZ and makes the latter available to the comparator 50. The comparator 50 furthermore compares the current flight time TZ with the flight time threshold value 52. The flight time TZ is slowed down on account of the increase in the load of the reciprocating pump 30 by the reagent 14 which is present. If it is now established that the flight time TZ is increased and exceeds the flight time threshold value 52, the comparator 50 withdraws the switching signal 54, whereupon the activation means 42 again provides the normal activation signal 44 without reducing the average power.

The invention claimed is:

1. A method of operating a reagent metering system (10) which meters a reagent (14) into an exhaust duct (16) of an internal combustion engine (18) upstream of an SCR catalytic converter (20), the method comprising:

emptying at least part of the reagent metering system (10) by back-suction by a reciprocating pump after the metering operation has ended;

determining a flight time (TZ) of a reciprocating piston of a reciprocating pump from a starting time (TS) as far as a stop time (TA) during the back-suction;

comparing the flight time (TZ), by a comparator (50), with a flight time threshold value (52); and reducing an activation power of the reciprocating pump (30) if the flight time (TZ) is less than the flight time threshold value (52).

2. The method according to claim 1, characterized in that a stop determination (48) determines the stop time (TA) of the reciprocating piston of the reciprocating pump (30) on the basis of an assessment of the temporal characteristic of the current (i) flowing through the reciprocating pump (30).

3. The method according to claim 1, characterized in that the average activation power of the reciprocating pump (30) is controlled by a pulse-width-modulated signal.

4. The method according to claim 1, characterized in that, after the average activation power of the reciprocating pump (30) is reduced, the flight time (TZ) of the piston of the reciprocating pump (30) is furthermore determined, in that a comparison of the flight time (TZ) with the flight time threshold value (52) is furthermore undertaken, and in that, whenever the flight time (TZ) exceeds the flight time threshold value (52), the reduction in the average activation power is ended.

5. A device for operating a reagent metering system (10), wherein a specially designed control device (26) is provided for carrying out the method according to claim 1.

6. A control device program which executes all of the steps of a method according to claim 1 when it runs on a control device (26).

7. A non-transitory machine-readable storage medium having program code for a control device program, the control device program carrying out the method according to claim 1 when the control device program is executed on a control device (26).

* * * * *